US008098028B2

(12) United States Patent
Trattler

(10) Patent No.: US 8,098,028 B2
(45) Date of Patent: Jan. 17, 2012

(54) CONTROL CIRCUIT AND METHOD FOR CONTROLLING LEDS

(75) Inventor: Peter Trattler, Graz (AT)

(73) Assignee: austriamicrosystems AG, Unterpremstätten (AT)

( * ) Notice: Subject to any disclaimer, the term of this patent is extended or adjusted under 35 U.S.C. 154(b) by 230 days.

(21) Appl. No.: 12/373,501

(22) PCT Filed: Jun. 20, 2007

(86) PCT No.: PCT/EP2007/005450

§ 371 (c)(1), (2), (4) Date: Aug. 12, 2009

(87) PCT Pub. No.: WO2008/006450

PCT Pub. Date: Jan. 17, 2008

(65) Prior Publication Data

US 2009/0309502 A1 Dec. 17, 2009

(30) Foreign Application Priority Data

Jul. 11, 2006 (DE) ..... 10 2006 032 071

(51) Int. Cl.
*G05F 1/00* (2006.01)

(52) U.S. Cl. ..... 315/307; 315/224

(58) Field of Classification Search ..... 315/209 R, 315/224, 225, 291, 307, 308
See application file for complete search history.

(56) References Cited

U.S. PATENT DOCUMENTS

| | | | | |
|---|---|---|---|---|
| 6,329,764 | B1 | 12/2001 | van de Ven | |
| 6,949,892 | B2 * | 9/2005 | Horiuchi et al. | 315/308 |
| 6,965,205 | B2 * | 11/2005 | Piepgras et al. | 315/318 |
| 2002/0070914 | A1 | 6/2002 | Bruning et al. | |
| 2002/0175632 | A1 | 11/2002 | Takeguchi | |
| 2003/0057888 | A1 | 3/2003 | Archenhold et al. | |
| 2004/0066652 | A1 | 4/2004 | Hong | |
| 2009/0128045 | A1 * | 5/2009 | Szczeszynski et al. | 315/185 R |
| 2010/0231132 | A1 * | 9/2010 | Logiudice et al. | 315/161 |

FOREIGN PATENT DOCUMENTS

| | | |
|---|---|---|
| DE | 102 23 027 | 5/2003 |
| DE | 600 19 689 | 2/2006 |
| EP | 1 071 070 | 6/2000 |
| EP | 1 274 065 | 7/2002 |
| EP | 1 471 493 | 4/2003 |
| KR | 2004-0045662 | 6/2004 |
| WO | WO 03/069958 | 8/2003 |
| WO | WO 2006/107199 | 10/2006 |

* cited by examiner

*Primary Examiner* — Don Le
(74) *Attorney, Agent, or Firm* — Cozen O'Connor

(57) ABSTRACT

A control circuit for control of light-emitting diodes has a first LED string (50) with at least one LED (51, 52, 53) and a first supply device (1) for supply of current to the first LED string (50). The supply device (1) has a control input (10) for delivery of a first control signal (CTL) and is provided for delivery, as desired, of a first supply current (IV1) or a second supply current (IV2) in dependence on the first control signal (CTL). The first and the second control currents (IV1, IV2) are non-zero.

24 Claims, 5 Drawing Sheets

CONTROL CIRCUIT AND METHOD FOR CONTROLLING LEDS

RELATED APPLICATIONS

This is a U.S. national stage under 35 USC §371 of application No. PCT/EP2007/005450, filed on Jun. 20, 2007.

This application claims the priority of German Patent Application. 10 2006 032 071.9 filed Jul. 11, 2006, the disclosure content of which is hereby incorporated by reference.

FIELD OF THE INVENTION

The invention concerns a control circuit for controlling light-emitting diodes, a method for control of light-emitting diodes, and a use of the control circuit.

BACKGROUND OF THE INVENTION

Light-emitting diodes, LEDs, as a rule have relatively strong emission of light and, at the same time, high light or current efficiency and small dimensions. LEDs can emit light in a light spectrum that can be assigned, for example, to the visible range or to an infrared range or to another non-visible frequency range.

LEDs can be used in any illumination system, for example, backlighting systems of the display screens of televisions or monitoring systems. It is possible through the use of LEDs to make available a lighting system with light distribution that is more uniform than, for example, a lighting system with neon light.

The brightness of an LED can be controlled, for example, by controlling the value of a current through the LED. However, this can lead to a change of the spectral color of the LED. Another possibility for controlling LEDs is the use of pulse width-modulated, PWM, or pulse density-modulated, PDM, control signals through which the LEDs are alternately switched on and off. In this case, the brightness of the LEDs is dependent on the timewise average value of the current through the LEDs, which is usually kept essentially constant in this case.

FIG. 8 shows an example of a traditional control circuit for controlling an LED string 50, which comprises three LEDs 51, 52 and 53, for example. A switch 26 and a current source 25 that are connected in series with the LED string 50 are provided for control. A supply terminal VS and a reference potential terminal VB are provided to supply voltage to the circuit. The switch setting of switch 26 is controlled via a control signal CTL.

In FIG. 9, a hypothetical control signal CTL is represented in a signal-time diagram. Here, the control signal CTL is a pulse width-modulated signal with duty cycle TON/TCYC.

The flow of current for the LED string 50 is switched completely on or completely off by the switching of switch 26 in dependence on the pulse width-modulated control signal CTL. This leads to high current peaks during switching, which has an unfavorable effect on the electromagnetic compatibility, EMC, or the electromagnetic effect, EME.

Moreover, nearly the entire supply voltage is present between the supply terminal VS and the reference potential terminal VB via the switch 26 in its open, nonconducting state. For this reason, it is necessary to dimension switch 26 or the control circuit appropriately, so that it can withstand the potential applied voltage.

SUMMARY OF THE INVENTION

One object of the invention is to provide a circuit for control of LEDs that can be designed for a low voltage load and that has improved behavior with respect to electromagnetic compatibility. Another object of the invention is to provide a method for controlling LEDs by which the behavior in the operation of the LEDs is improved with respect to electromagnetic compatibility.

In an embodiment of the invention, a control circuit for control of LEDs comprises a first LED string with at least one LED and a first supply device for supplying current to the first LED string. The first supply device has a control input for feed of a first control signal and is arranged for delivery, as desired, of a first supply current or a second supply current, in dependence on the first control signal. In doing so, the first and the second supply currents are, in each case, non-zero.

For example, the first supply current corresponds to current at full modulation of the LED string, i.e., delivery of light at maximum brightness. The second supply current can be a lower current, which produces only low emission intensity of the LED string. Since the current through the LED string, in contrast to traditional control, is no longer switched completely on and off, but rather is switched, in accordance with the invention, between two values, for example a higher and a lower value, current variations and voltage peaks in the switching operation can be reduced. Moreover, the voltage across the diode string is lower at a lower current. This way, in contrast to the traditional solution, the control circuit or the supply device, even in the case of the lower current, is not loaded by the complete value of a supply voltage source. In addition, the voltage difference between the delivery of the first and second supply current is reduced.

Through the reduced current variations and the smaller voltage variations the behavior of the circuit with respect to electromagnetic compatibility, or electromagnetic effect, is improved.

In one embodiment of the invention, the first supply device has a first current source for delivery of a first current and a second current source for delivery of a second current. In this case, in the first supply device, the first supply current is made up of the sum of the first and the second currents, and the second supply current is made up of the second current.

The first and second current sources can be dimensioned so that the second current source, for example, provides a lower second supply current, while the first current source delivers a current that, together with the current of the second current source, yields the first supply current. In this case, the second, smaller current source is permanently loaded. The first current source is appropriately switched in dependence on the first control signal. For example, a PWM or PDM signal can be used as control signal.

Since, in turn, for the delivery of both the first and of the second supply currents, a voltage over the diode string is not necessary, the first and second current sources can be provided with a voltage load capacity that is lower than a voltage for supply of the LED string.

In another aspect of the invention, the first supply device has a conversion device, through which the level of the first and second supply currents can be adjusted in dependence on a relevant digital control word. In this case, the first supply device is set to generate the relevant control words for the first and second supply current in dependence on the first control signal.

For example, the conversion device comprises a digital-analog converter for conversion of a digital control word to a current. A first control word can be converted by the control device to the first supply current or a second digital control word can be converted to the second supply current. Depending on the first control signal, the appropriate digital control word for the conversion device can be generated in the first supply device.

This advantageously results in reduced current variations and voltage peaks in switching between the first and second supply currents and improved electromagnetic compatibility of the arrangement.

The first supply device can have a computing unit or a switchable register, which in each case is provided to make available the relevant digital control word in dependence on the first control signal.

In another advantageous embodiment of the invention, a first or a second voltage can be converted to a current in the first supply device in dependence on the first control signal. In this case, the first supply current can be taken from the first voltage and the second supply current can be taken from the second voltage.

For conversion of the first and second voltages, a resistor can be provided. For example, the first supply device has an amplifier with a first input for feed of the first or second voltage, a second input and an output, and a transistor with a control terminal coupled to the output of the amplifier. In this case, the resistor is connected in series with the controlled path of the transistor, and the second input is coupled to a connecting junction between the resistor and the transistor.

The transistor in this case is controlled by the amplifier, which is designed, for example, as an operating amplifier, so that the first or second supply current flows through the transistor. This takes place in dependence on the first or second voltage, which can be sent to the amplifier as desired, and in dependence on the resistor. Because of the permanent voltage drop across the diode string, the voltage load of the transistor is lower even for a low supply current than in the case of a traditional solution.

In another aspect of the invention, the control circuit comprises at least one additional LED string with at least one LED and an additional supply device for each of the additional LED strings, for supply of current to the relevant additional LED string. Here a particular additional supply device has a control input for feed of a particular additional control signal and is set up optionally to deliver a particular additional first supply current or a particular additional second supply current in dependence on the additional control signal so that the additional first and the additional second supply currents are non-zero.

According to an embodiment of the invention, the additional supply devices can be designed in the same way as the previously described embodiments for the first supply device.

Through this, different LED strings can be controlled by the different particular supply devices in different ways or with different control signals.

For example, the first and the at least one additional LED string can be set up to emit light in frequency spectra that differ from each other. For instance, LED strings could be provided for at least the colors red, green and blue, and each of the LED strings can emit one of the colors.

The LED strings can be controlled, for example, so that white balance regarding the emitted colors can be undertaken through the control.

A control circuit according to one of the embodiments described above, can be used, for example, in a lighting system for display panels or television systems. Here, the circuit is especially suitable for use in a background illumination system (backlight system), for example, an LCD monitor.

In one embodiment of a method in accordance with the invention, in a method for control of LEDs, a non-zero first supply current is sent to a first LED string with at least one LED during a first time segment, in dependence on a first control signal. In addition, a non-zero second supply current is sent to the first LED string during a second time segment, in dependence on the first control signal.

Since the LED string can be alternately supplied with the first or the second supply current, current changes in the transition from the first to the second supply current are reduced compared to traditional solutions. This has an advantageous effect on the operating behavior of the LEDs with respect to electromagnetic compatibility.

According to an embodiment of the invention, the second time segment can follow the first time segment, and a direct transition from the first to the second time segment is also possible. The method in accordance with the invention can also be used for additional LED strings.

BRIEF DESCRIPTION OF THE DRAWINGS

In the following, the invention is explained in more detail in a number of embodiments with reference to the figures. Elements that are like in function or activity have the same reference numbers.

DETAILED DESCRIPTION OF THE DRAWINGS

Figure 1:
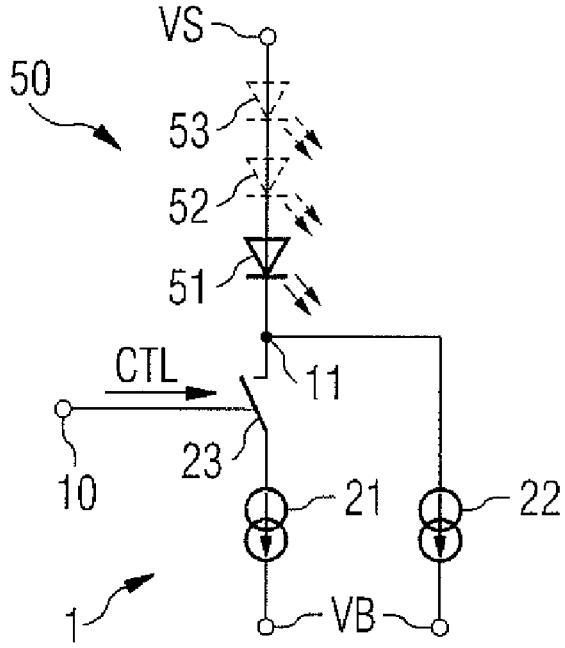
FIG. 1 shows a first embodiment of a control circuit in accordance with the invention.

FIG. 1 shows a first example embodiment of a control circuit in accordance with the invention for control of LEDs. A first LED string 50 with, for example, three LEDs 51, 52 and 53, is provided, where more or fewer LEDs is also possible. Also shown are a first supply device 1, which has a first current source 21 and a second current source 22. Junctions 11 form the current output of the supply device 1. The second current source 22 is connected so that the current generated by it is permanently flows via current output 11. The first current source 21 can optionally be switched on or off by switch 23 in order to, additionally to the second current source 22, feed a current at current output 11. Switching a switch 23 takes place in dependence on a control signal CTL at a control input 10. The LED string 50 is connected on the cathode side to a supply terminal VS, via which a supply potential can be supplied. Current sources 21 and 22 in this example are coupled to a common reference potential terminal VB.

In the embodiment that is shown, the direction of flow of current sources 21 and 22 and mounting direction of diodes 51, 52 and 53 can be reversed and the supply connection VS and the reference potential connection VB can be exchanged without going beyond the scope of the invention.

The LED string 50 can be provided with current through the supply device 1. If switch 23 is closed, the sum of the current from the first current source 21 and the current from the second current source 22 forms a first supply current IV1, which corresponds, for example, to a current for high illumination intensity of the LED string 50. If the switch 23 is open, a second supply current IV2 is itself formed by the current from the second current source 22. The second supply current IV2 in this case usually leads to a low illumination intensity of LED string 50. Through the appropriate activation of switch 23, the LED string 50 can optionally be supplied with the first or the second supply current IV1 or IV2, so that an average current results over time, which results in a timewise averaged illumination intensity.

Figure 2:
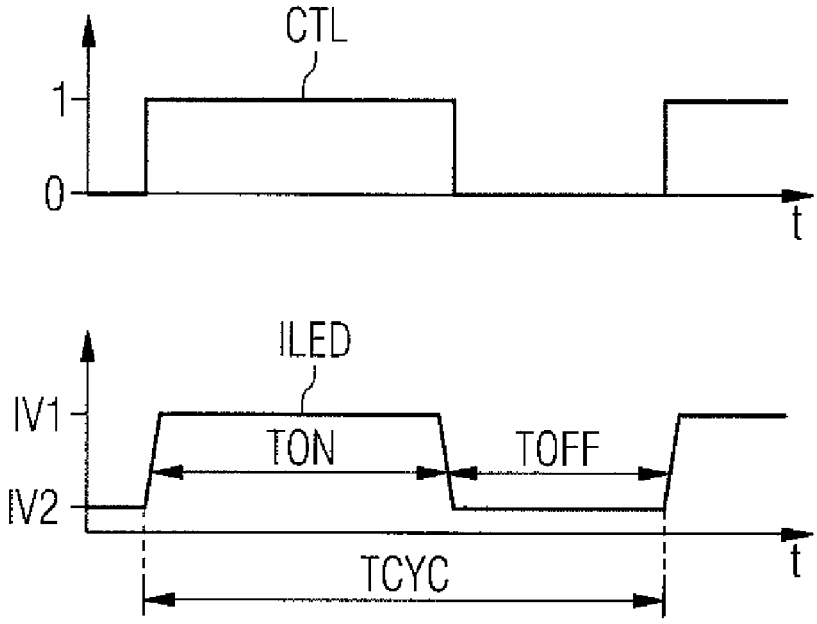
FIG. 2 shows a first signal-time diagram for a control signal and a current in an embodiment of the invention.

FIG. 2 shows a signal-time diagram of an example control signal CTL and a resulting current ILED through the LED string 50. The control signal CTL is, for example, during a first time segment TON, at a high signal level, which corresponds to a closed switch 23. During the second time segment TOFF, the control signal CTL has a low signal level corresponding to an open switch 23. The control signal CTL in this example is a pulse width-modulated signal with period length TCYC and example duty cycle TON/TCYC.

During the first time segment TON, the first supply current IV1 flows through the diode string 50 as current ILED. During the second time segment TOFF, the lower second supply current IV2 correspondingly flows. The first and second time segments, TON and TOFF, usually alternate periodically. Thus, as the average current ILEDAVG of the diode current ILED we have:

$$ILEDAVG = \frac{\text{TON}}{TCYC} \cdot IV1 + IV2 \tag{1}$$

A timewise ratio of the lengths of the first and second time segments TON and TOFF is thus dependent on a set average value ILEDAVG for a current ILED through the first LED string 50, and on the relevant value of the first and second supply currents IV1 and IV2. For example, the first supply current IV1 corresponds to a value of the maximum output current of a conversion device (such as the conversion device 30 discussed below) or the current for the high illumination intensity of LED string 50. The lower second supply current IV2 can, for instance, have a value of 4% of the first supply current IV1.

When the second supply current IV2 flows through the LED string 50, the color temperature of the LEDs 51, 52 and 53 undergoes a slight spectral shift by comparison to the first supply current IV1. However, since, at the same time, the illumination temperature with the second supply current IV2 is usually very low, such a color shift can be neglected in operation.

By adjusting the duty cycle TON/TCYC, the average effective brightness of the LED string 50 can be adjusted. The control signal CTL therefore can, for example, with its duty cycle, correspond to a brightness. In this case, the timewise average of a pulse width-modulated control signal CTL is derived from a preset average value for a current through the first LED string 50. Therefore, the brightness of the LED string 50 can be dimmed. For control of the control switching in accordance with the invention, the control signal CTL can, besides a pulse width-modulated signal, be any pulsed signal, which can be generated with many different control methods.

Since a current MED flows through the LED string 50, both for an open as well as for a closed switch 23, there is a certain voltage drop across the LEDs 51, 52 and 53. Because of this, in every case, the potential at the current output 11 is lower than a supply potential at supply terminal VS. A voltage load capacity of current sources 21 and 22 therefore can become lower than for the full supply voltage. In addition, the voltage level between open and closed switch 23 is reduced. For example, the forward voltage of LEDs 51, 52 and 53 for the lower second supply current IV2 is 2 volts, while for the higher first supply current IV1, it is 3.5 volts. Through this, one has a voltage impedance of only 1.5 volts per LED in LED string 50. With a traditional solution, in which the current through the LED string 50 is completely switched off, the voltage impedance per LED is a value up to the full value of the diode voltage of 3.5 volts. Through such reduced voltage impedance made possible in accordance with the invention, the behavior with regard to electromagnetic compatibility is also improved.

If the LED string 50 is to be dimmed to very low brightness, switch 23, for example, can remain permanently open if the control signal CTL is appropriate. In this way, a low brightness can be adjusted without carrying out switching operations in the supply device 1. Due to this, noise in the system due to switching operations is reduced or eliminated.

Figure 3:
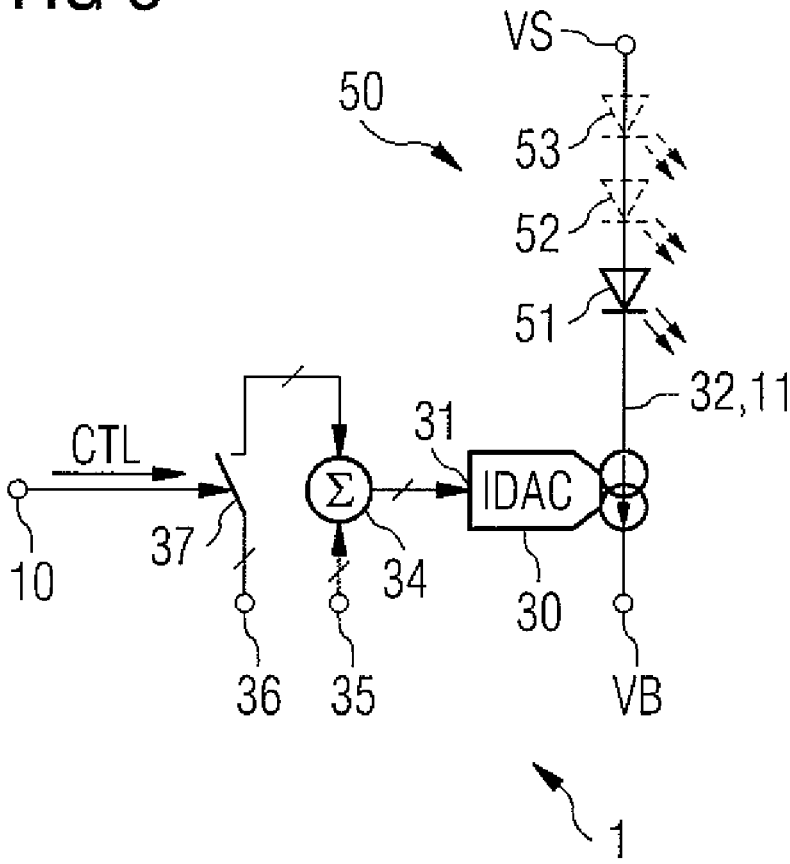
FIG. 3 shows a second embodiment of a control circuit in accordance with the invention.

FIG. 3 shows another embodiment of a control circuit in accordance with the invention. The supply device 1 in this case includes a conversion device 30 for converting a digital control word at input 31 to a current, which is output at output 32 of conversion device 30, which at the same time forms the current output 11 of the supply device 1. In this way, the levels of the first and second supply currents IV1 and IV2 can be adjusted in dependence on a relevant digital control word.

The supply device 1 also includes an adder 34 to send the digital control word to input 31, which is coupled on one side to a digital input 35 and, via a switch 37, to a digital input 36. Switch 37 can in turn be controlled with regard to its switching state via a control word CTL delivered to the control input 10.

For example, digital words are input via digital inputs 35 and 36. If switch 37 is closed, a first digital control word will result from the sum of the digital words at inputs 35 and 36. The first digital control word is converted by the conversion device 30 to the first supply current IV1. If switch 37 is open, a second digital control word will result at the output of the adder 34, which corresponds to the digital control word input at input 35 and is converted to the second supply current IV2.

Conversion device 30 comprises, for example, a number of transistors connected as a current mirror, which are open or closed in dependence on the digital control word at input 31. Here, the currents of the transistors connected as a current mirror are added and output at output 32 as output current, in this case as the first or second supply current.

For example, the digital word at input 35 corresponds to a value of 4% of the maximum output current of conversion device 30, while the digital word at input 36 represents 96% of the maximum output current. Instead of the maximum output current of conversion device 30, a current value for the high illumination intensity of LED string 50 can also be specified.

Supply device 1 thus, as desired, outputs a current via conversion device 30 with 100% lighting intensity or with lighting intensity corresponding to the 4% second supply current The control signal CTL can, again, be a pulse width-modulated signal in accordance with FIG. 2.

The advantages of the reduced voltage load capacity requirements, the improved EMC and the reduction of switching noise for low lighting intensities also apply for this embodiment.

Figure 4:
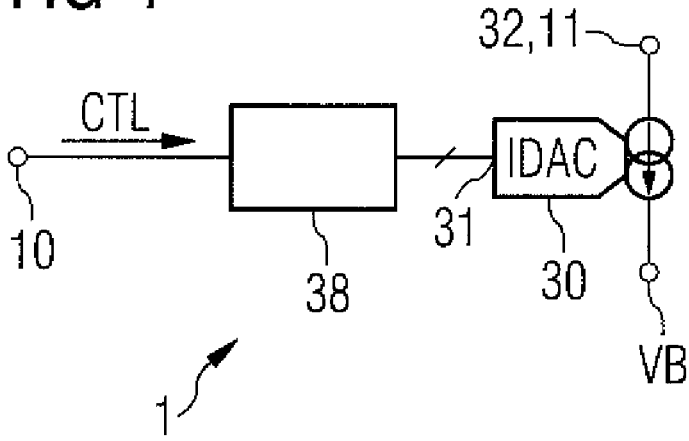
FIG. 4 shows an embodiment of a supply device in accordance with the invention.

FIG. 4 shows an alternative embodiment of a supply device 1. Here, a switchable register or a computing unit 38 is specified that can deliver an appropriate first or second control word to the input 31 of the conversion device 30 in dependence on the control signal CTL at the control input 10. For example, a computing unit 38 is designed as a microprocessor, to which a value for a desired lighting intensity is sent as control signal CTL. The microprocessor in this case alternately delivers the first and second digital control words, which are converted by the conversion device 30 to the first and second supply currents. Therefore, the relevant digital control words for the first and second supply currents IV1 and IV2 are generated in supply device 1 in dependence on the control signal CTL. The levels of the first and second control currents IV1 and IV2 are established in dependence on a relevant digital control word.

If a switchable register 38 is used, it can be controlled so that, as desired, the first digital control word corresponding to the first supply current IV1 or the second digital control word corresponding to the second supply current IV2 is output to the conversion device 30. This can take place, for example, via appropriate wiring with signal levels from output conductors in dependence on the control signal CTL.

Figure 5:
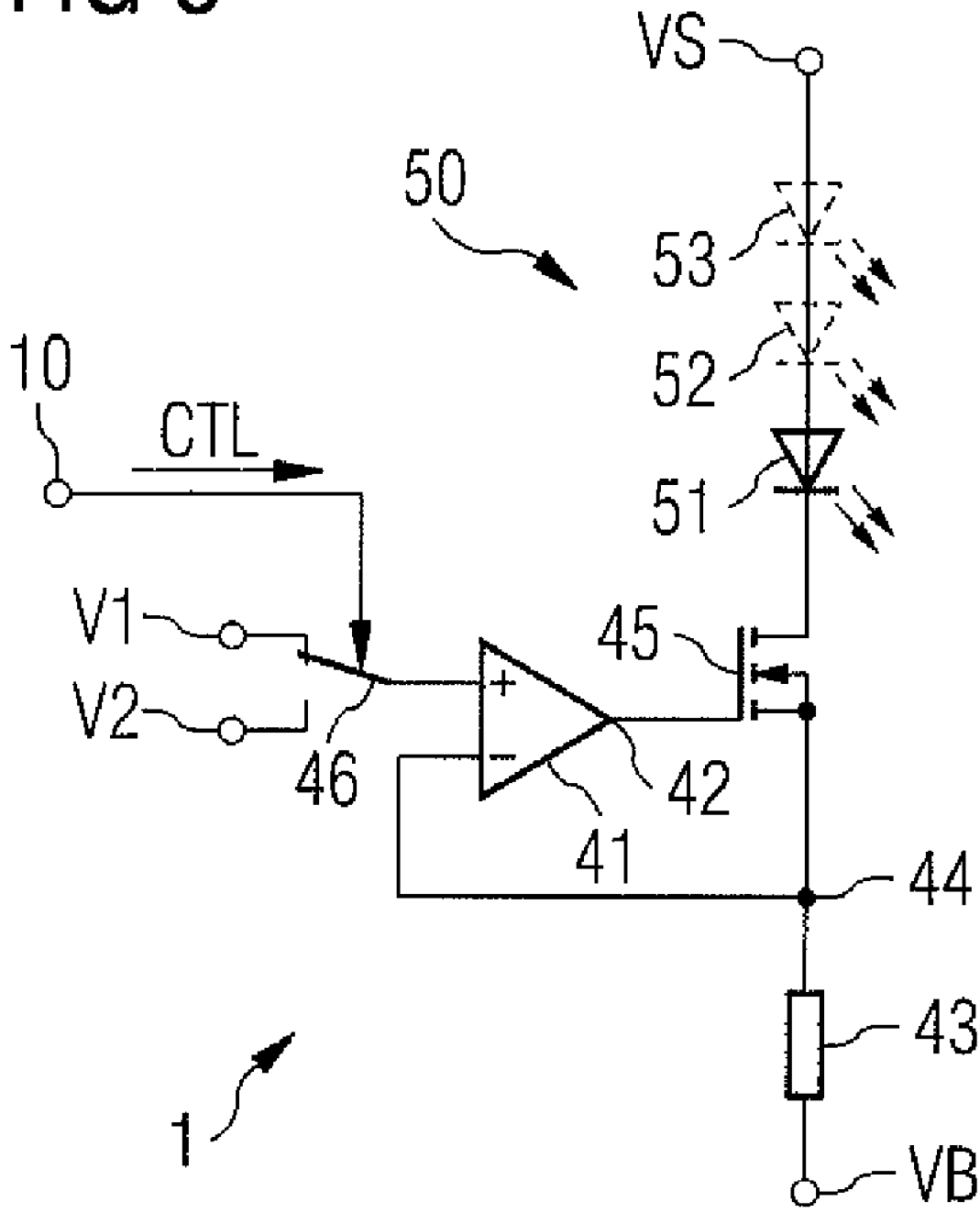
FIG. 5 shows a third embodiment of a control circuit in accordance with the invention.

FIG. 5 shows another alternative embodiment of a control circuit in accordance with the invention. The supply device 1 includes inputs for feed of a first and a second voltage V1 and V2, which can be sent to the (+) input of an amplifier 41, in dependence on the switching position of a switch 46. One output 42 of the amplifier is coupled to the control terminal of a transistor 45. In addition, there is a resistor 43 that is connected in series with the controlled path of transistor 45. A connecting terminal 44 between resistor 43 and transistor 45 is coupled to the second (−) input of amplifier 41.

Depending on the control signal CTL the first or the second voltage V1 or V2 is sent as desired to amplifier 41. The amplifier is connected so that the transistor 45 is controlled so that a current through transistor 45 corresponds in each case to the first or the second supply current IV1 or IV2. Here, voltage V1 or V2 and resistance R of resistor 43 are dimensioned so that the currents of the first and second supply currents IV1 and IV2 are:

$$IV1 = \frac{V1}{R};\quad IV2 = \frac{V2}{R} \tag{2}$$

For example, again, the first supply current IV1 corresponds to a current for 100% lighting intensity, while current IV2 amounts to 4% of the first supply current IV1. To control switch 46, again, a pulse width-modulated control signal CTL is used, through which the first voltage V1 becomes activated in the first time segment TON and the second voltage V2 is activated in the second segment TOFF. An average current through the LED string 50 thus is:

$$ILEDAVG = \frac{V1\cdot \mathrm{TON} + V2\cdot (TCYC - \mathrm{TON})}{R} = \frac{V1\cdot \mathrm{TON} + V2\cdot TOFF}{R} \tag{3}$$

If the current is output through supply device 1, then the first voltage V1 is converted in the first time segment TON to the first supply current IV1 and a second voltage V2 is converted in the second time segment TOFF to the second supply current IV2. The second time segment TOFF follows the first time segment TON, as is evident from FIG. 2.

Besides the indicated N-channel field effect transistor, which can be designed, for example, as a N-metal oxide semiconductor NMOS transistor, it is also possible to use P-channel field effect transistors, for example, PMOS transistors. Alternatively, it is also possible to use NPN or PNP bipolar transistors. If other types of transistors are used, one should always keep in mind the polarity of the amplifier 41.

If a control circuit in accordance with this embodiment is implemented in a chip with appropriate housing, it is sufficient to provide a single pin for connection of the one required resistor. Thus, this control circuit can also be implemented with low expense.

Figure 6:
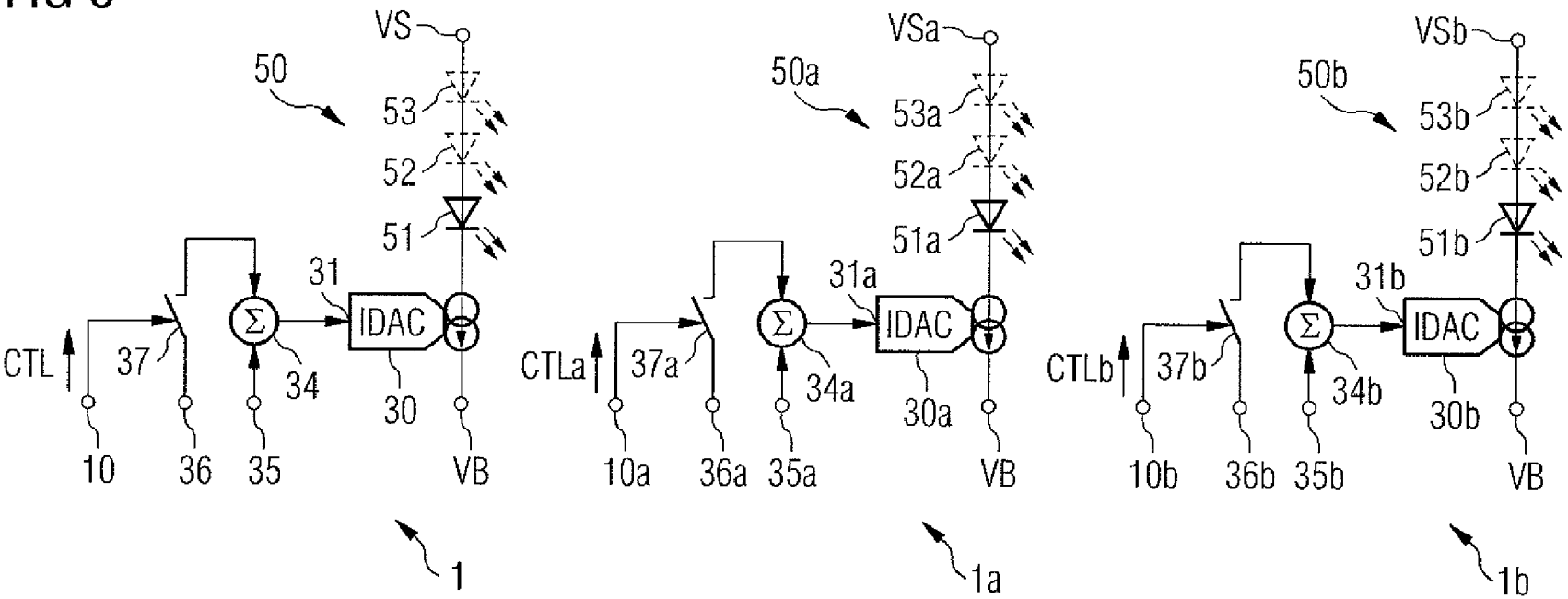
FIG. 6 shows a fourth embodiment of a control circuit in accordance with the invention.

FIG. 6 shows another embodiment of a control circuit in accordance with the invention, in which, besides a supply device 1 and LED string 50 in accordance with FIG. 3, there are two additional supply devices 1*a* and 1*b* with their relevant LED strings 50*a* and 50*b*. The mode of functioning of the additional supply devices 1*a* and 1*b* corresponds to that of supply device 1.

Thus, supply device 1*a* has a conversion device 30*a* with input 31*a*, to which adder 34*a* sends the result of addition of digital words at inputs 35*a* and 36*a* in dependence on the position of a switch 37*a*. The position of switch 37*a* is controlled via an additional control signal CTLa, which is sent via an additional control input 10*a*. In this way, an additional first or second supply current is sent to the relevant one of LEDs 51*a*, 52*a* or 53*a*. The LED string 50*a* is connected to an additional supply terminal VSa, which can have a different potential from supply terminal VS.

A third supply device 1*b* is formed analogously with conversion device 30*b*, input 31*b*, adder 34*b*, inputs 35*b* and 36*b*, switch 37*b* and control input 10*b* for delivery of an additional control signal CTLb. The LED string 50*b* comprises LEDs 51*b*, 52*b* and 53*b* and is, again, coupled to a supply terminal VSb, the potential of which can be independent of the other supply terminals VS and VSa.

Embodiments as in FIG. 1 or FIG. 5 can also be used for the supply devices 1, 1*a* and 1*b* in this embodiment.

The LED strings 50, 50*a* and 50*b* comprise, for example, LEDs for different colors in each case. For instance, LED string 50 is intended for the color red, the LED string 50*a* for the color green and LED string 50*b* for the color blue. The brightness, or lighting intensity, can be independently controlled for each of the LED strings 50, 50*a* and 50*b* via the appropriate control signals CTL, CTLa and CTLb, as shown as an example in FIG. 2. A combination of such LED colors, red, green and blue (RGB) is usually used so that the light emitted jointly from LED strings 50, 50*a* and 50*b* appears as white light. To adjust the color temperature of the light resulting from the combination, it is necessary to appropriately control the brightness of the individual LED strings 50, 50*a* and 50*b*. Here, one also speaks of a white balance or establishment of a white point. Since the sampling ratio of control signals CTL, CTLa and CTLb usually lies in the range between 80 and 90% in the case of a white balance, a slight color shift due to the lower second supply current to the individual LED strings 50, 50*a* and 50*b* can, in turn, be neglected.

For example, values for each of the individual supply devices 1, 1*a* and 1*b* for different desired total brightnesses are known and stored in a system for generating the control signals CTL, CTLa and CTLb, so that, if necessary, they can be called from the memory.

Alternatively, the color temperature of the emitted light can be measured and used for readjustment of the relevant brightnesses of the individual LED strings 50, 50*a* and 50*b*.

Besides generation of white light by the RGB LED strings 50, 50*a* and 50*b*, it is possible to generate nearly any other color as well. Here again, the corresponding brightnesses of the LED strings 50, 50*a* and 50*b* are established via the control signals CTL, CTLa and CTLb.

The present invention is not limited to the three LED strings 50, 50*a* and 50*b* indicated here. For example, besides RGB, it is possible to provide an LED string for the color amber, for example, to have the color temperature of the overall emitted light to appear warmer.

Alternatively, in addition to a string with white LEDs, a second LED string with red LEDs can be provided, so that a warmer white can be generated.

Figure 7:
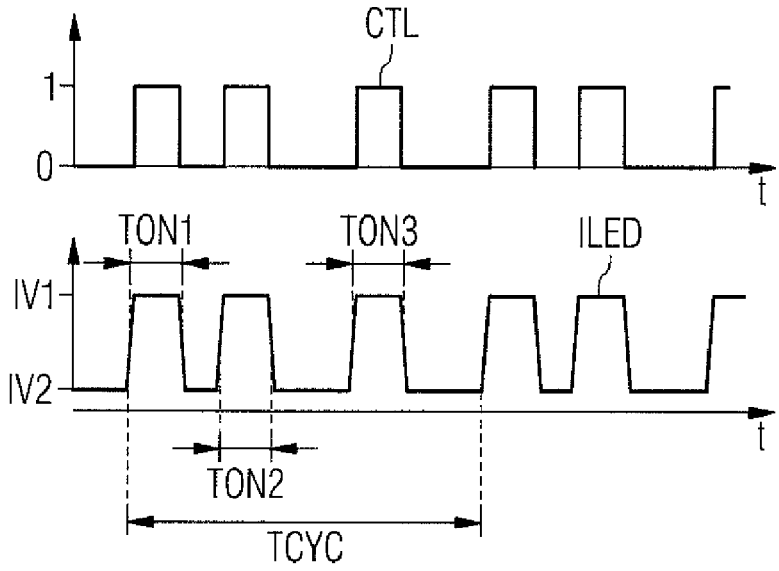
FIG. 7 shows a second signal-time diagram for a control signal and a current in an embodiment of the invention.
Figure 8:
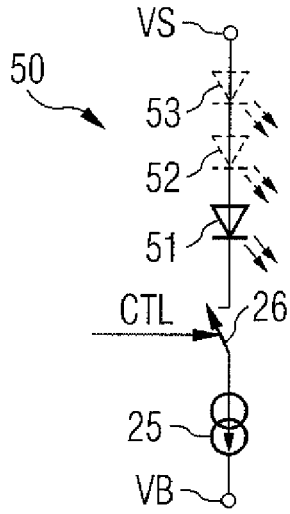
FIG. 8 shows an embodiment of a traditional control circuit and FIG. 9 shows a signal-time diagram for control of a traditional control circuit.
Figure 9:
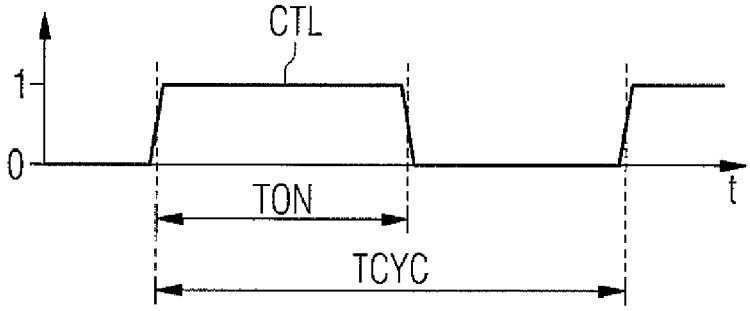

FIG. 7 shows another signal-time diagram in which a pulse density-modulated control signal CTL is shown. The time-wise average value of the pulse density-modulated control signal is again derived from a preset average value for a current through the relevant LED string. The average value results from a frequency of pulses during a time segment, for example, a period duration TCYC. In the embodiment in FIG. 7, the control signal CTL has a high signal level during time segments TON1, TON2 and TON3, while it lies at a low signal level in the remaining time of period TCYC. In this way, in a supply device 1 in accordance with the invention, for example, as in FIG. 1, 3 or 5, the first supply current IV1 is produced in time segments TON1, TON2 and TON3, while the second supply current IV2 is produced in the remaining time. In relation to equation (1) or (3), the first time segment TON results in $$\mathrm{TON} = \sum_i TON_i \tag{4}$$

for a pulse density-modulated signal with a number of short pulses of duration $\mathrm{TON}_i$, so that for the embodiment in FIG. 7, we have:

$$TON = TON1 + TON2 + TON3 \tag{5}$$

For example, the pulse density-modulated signal is generated by a sigma-delta modulation.

Pulse density-modulated signals can also be set for control of a number of LED strings, for example, as in FIG. 6.

A control circuit in accordance with the invention for control of one or more LED strings can be used, for example, in a lighting system for display panels. Here, it can advantageously be used in the display panels of mobile phones or personal digital assistants, in which the display can be darkened when not in use in order to save batteries. According to the present invention, a second supply current can be established so that it corresponds to a current for darkened operation. With that, switching operations in the supply device can be omitted for the darkened operation, which, besides reducing the current consumption, has positive effects on the electromagnetic compatibility as well as switching noise.

The present invention can also be used to control light-emitting strings with other types of light-emitting devices.

The invention claimed is:

1. A control circuit for control of light-emitting diodes, comprising:

a first LED string with at least one LED; and a first supply device for supply of current to the first LED string, which has a first current source to supply a first current, a second current source to supply a second current, and a control input for feed of a first control signal and that is furnished for optional delivery of a first supply current or a second supply current in dependence on the first control signal so that the first and second supply currents are non-zero, the first supply device further having a conversion device, through which a level of the first and second supply currents is establishable dependent on a relevant digital control word, and which is arranged to generate relevant control words for the first and second supply currents dependent on the first control signal;

wherein, in the first supply device, the non-zero first supply current results from the sum of the first and second currents, and the non-zero second supply current results from the second current.

2. The control circuit as in claim 1, wherein the first supply device has a computing unit or a switchable register, in each case for making available the relevant digital control word dependent on the first control signal.

3. The control circuit as in claim 1, wherein, dependent on the first control signal, a first or a second voltage is convertible in the first supply device to a current, and the non-zero first supply current is derivable from the first voltage and the non-zero second supply current is derivable from the second voltage.

4. The control circuit as in claim 3, wherein a resistor is provided for the conversion of the first and second voltages.

5. The control circuit as in claim 4, wherein the first supply device has an amplifier with a first input for feed of the first or the second voltage, a second input and an output and a transistor with a control terminal coupled to the output of the amplifier, and wherein the resistor is connected in series with the control path of the transistor and the second input is connected to a connecting junction of the resistor and the transistor.

6. The control circuit as in claim 1, further comprising:

at least one additional LED string with at least one LED; and for each of the additional LED strings, an additional supply device for supply of current to a relevant additional LED string, which has a control input for feed of a relevant additional control signal and that is arranged to deliver a relevant additional first supply current or a relevant additional second supply current dependent on the relevant additional control signal so that the relevant additional first and second supply currents are non-zero.

7. The control circuit as in claim 6, wherein the first and the at least one additional LED string are arranged for emission of light with frequency spectra that differ from each other.

8. The control circuit as in claim 6, wherein the LED strings are provided at least for the colors red, green and blue.

9. A lighting system for display panels comprising a control circuit as in claim 1.

10. A method for controlling light-emitting diodes, comprising the steps of:

providing a first current source for delivery of a first current, and a second current source for delivery of a second current;

forming a first non-zero supply current from the sum of the first and second currents;

feeding the first supply current to a first LED string that has at least one LED during a first time segment dependent on a first control signal; and feeding a non-zero second supply current to the first LED string during a second time segment dependent on the first control signal;

wherein relevant digital control words for the non-zero first and second supply currents are generated dependent on the first control signal, and a level of the non-zero first and second supply currents is established dependent on the relevant digital control word.

11. The method as in claim 10, wherein upon delivery, a first voltage is converted to the non-zero first supply current in the first time segment and a second voltage is converted to the non-zero second supply current in the second time segment.

12. The method as in claim 10, wherein the second time segment follows the first time segment.

13. The method as in claim 10, wherein the first and second time segments periodically alternate.

14. The method as in claim 10, wherein a timewise ratio of a duration of the first and the second time segments is dependent on a preset average value for current through the first LED string and on a relevant value of the non-zero first and second supply currents.

15. The method as in claim 10, wherein the first control signal is made available as a pulse width-modulated signal, whose timewise average value is derived from a preset average value for current through the first LED string.

16. The method as in claim 10, wherein the first control signal is made available as a pulse density-modulated signal, whose timewise average value is derived from a preset average value for current through the first LED string.

17. The method as in claim 16, wherein the pulse density-modulated signal is produced by sigma-delta modulation.

18. The method as in claim 10, wherein the first control signal corresponds to a brightness.

19. The method as in claim 10, further comprising the steps of:

delivering a relevant non-zero additional first supply current to a relevant additional LED string during a relevant additional first time segment dependent on a relevant additional control signal for each additional LED string of LED strings with at least one LED; and delivering a relevant non-zero additional second supply current to the relevant additional LED string during a relevant additional second time segment dependent on a relevant additional control signal for each additional LED string of the LED strings with the at least one LED.

20. The method as in claim 19, wherein the relevant additional second time segment follows the relevant additional first time segment.

21. The method as in claim 19, wherein the first and the additional LED strings emit light with frequency spectra that differ from each other.

22. The method as in claim 21, wherein the LED strings emit light at least with the colors red, green and blue.

23. The method as in claim 21, wherein light of any color is given off dependent on the first and the relevant additional control signals.

24. The method as in claim 21, wherein a white point of the emitted light is established dependent on the first and the relevant additional control signals.

* * * * *